US005590601A

United States Patent [19]

Theurer et al.

[11] Patent Number: 5,590,601

[45] Date of Patent: Jan. 7, 1997

[54] TRACK WORKING MACHINE

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 576,154

[22] Filed: Dec. 21, 1995

[30] Foreign Application Priority Data

Jan. 3, 1995 [AT] Austria ..... A 8/95

[51] Int. Cl.[6] ..... E01B 29/00

[52] U.S. Cl. ..... 104/2

[58] Field of Search ..... 104/2, 3, 5, 7.1, 104/7.2, 15

[56] References Cited

U.S. PATENT DOCUMENTS

| | | | |
|---|---|---|---|
| 5,193,461 | 3/1993 | Theurer et al. | 104/7.1 |
| 5,195,436 | 3/1993 | Valditerra | 104/15 |
| 5,222,435 | 6/1993 | Theurer et al. | 104/2 |
| 5,469,791 | 11/1995 | Theurer et al. | 104/7.1 X |

FOREIGN PATENT DOCUMENTS

| | | | |
|---|---|---|---|
| 416083 | 7/1925 | Germany | 104/5 |

*Primary Examiner*—S. Joseph Morano
*Attorney, Agent, or Firm*—Henry M. Feiereisen

[57] ABSTRACT

A track working machine includes a machine frame extending in longitudinal direction along a track and supported by undercarriages for mobility in an operating direction along the track. The machine frame exhibits a first work section situated between two undercarriages and a second work section immediately trailing the first work section in the operating direction. A self-propelled transport unit travels along guide rails which are mounted in the longitudinal direction onto the machine frame. The machine frame is formed in the area of the first work section essentially by two parallel beams extending in the longitudinal direction and spaced transversely to the machine frame, with the parallel beams being connected together by a traverse heading disposed above the guide rails to thereby enable the transport unit to move from the second work section underneath the traverse heading into the first work section.

9 Claims, 2 Drawing Sheets

TRACK WORKING MACHINE

BACKGROUND OF THE INVENTION

The present invention refers to a track working machine, and in particular to a track working machine of a type including a machine frame supported on undercarriages for movement in an operating direction along a track, and exhibiting a first work section extending between two undercarriages and a second work section trailing the first work section in operating direction, with guide rails being mounted on the machine frame in the longitudinal direction for allowing a self-propelled transport unit to travel along the guide rails between the first and second work sections.

U.S. Pat. No. 5,193,461 discloses a track working machine of this type for exchanging old ties of a railroad track for new ties. The first work section is positioned between two successive undercarriages and is formed with an opening to enable tie gripping means to pass therethrough. The second work section is provided with guide rails for conducting a transport unit in the form of a self-propelled tie crane in an operating direction. A tie transport car which receives and stores ties is coupled to the machine frame. The guide rails are suitably extended and mounted also atop the transport car to enable the crane to move between the machine frame and the tie transport car along the track towards and away from a tie exchange device. Thus, old and new ties are respectively transported by the crane and passed through the opening in the machine frame for removal from or placement on a tie depositing device which is positioned underneath the opening and cooperates with the tie exchange device.

French Pat. No. 2,378,898 discloses a track working car for depositing and receiving track panels. The car includes a machine frame which is supported at its ends by undercarriages and carries an arched structure that extends transversely to the machine frame. The structure projects on both longitudinal ends beyond the respective undercarriage and includes guide rails in the upper end zone which extend in longitudinal direction and conduct carriages for transporting track panels over the entire length of the structure in the longitudinal direction.

SUMMARY OF THE INVENTION

It is an object of the present invention to provide an improved track working machine which is suitable in particular for use in areas of a switch or a crossing.

This object and others, which will become apparent hereinafter, are attained in accordance with the present invention by forming the machine frame along the first work section essentially of two parallel beams which extend in the longitudinal direction and are spaced transversely to the machine frame, with the parallel beams being connected together in an area between the undercarriages above the guide rails by only a traverse heading, and by providing a transport unit to travel from the second work section beneath the traverse heading into the first work section.

Through the provision of a track working machine in accordance with the present invention, bulky and/or oversized track elements, which are encountered e.g. during installation and modification of switches, can be easily handled at the job site. Such bulky and/or oversized track elements can be supplied by a transport unit from e.g. a coupled loading car and transported along the guide rails directly to the job site which is located underneath the first work section. The subsequent maneuvering of the track elements into the desired, correct position is especially simple by the particular configuration of the machine frame because the lower region of the longitudinal beams is not obstructed by any frame structure that is laid across. Thus, the freedom of mobility and a clear view of the construction site underneath the guide rails are not adversely affected at all. Also, despite creating an optimal clearance zone for the personnel, the traverse heading above the guide rails imparts the machine frame with a necessary twist stiffness which is maintained even when extending the first work section to a maximum length through respectively distancing the undercarriages from one another. The thus created space is also advantageous because it allows incorporation of additional equipment and enhances the freedom of mobility for maintenance personnel. The available maneuvering space may be even further increased by upwardly angling the longitudinal beams in a gooseneck-type configuration along the first work station, while still retaining the stiffness of the overall structure.

Suitably, the guide rails extend along the first and second work sections in a plane that lies immediately above the undercarriages to optimize the mobility of the transport unit.

According to another feature of the present invention, the transport unit is formed by a gantry crane which is supported by undercarriages for mobility on the guide rails. Respectively mounted on the longitudinal ends of the gantry crane are two operator's cabs, each of which being equipped with a central control mechanism for operating a grappler for gripping and transporting track sections. The grappler projects beyond the respective end face of the gantry crane and is vertically and laterally adjustable. In this manner, the range of operation for the transport unit is maximized to carry out all kinds of different maneuvers.

Preferably, also the first work section is provided with an operator's cab at the distal end from the second work section in order to enable the personnel to rapidly reach the construction site and, above all, to protect the personnel during work, without risking injury by trains that may run on side tracks.

According to yet another feature of the present invention, the machine frame includes two carrier frames which respectively form the first and second work sections and are arranged sequentially behind one another in operating direction and detachably linked via a coupling. Suitably, the carrier frame forming the second work section is configured as flatbed car to e.g. receive and store track sections. In this manner, the track working machine can be best suited to various applications and transport conditions.

A track working machine, according to the present invention, may be integrated in a mobile work train for performing track work. For example, the track working machine according to the present invention may be preceded by first track-bound equipments for removing rail fasteners and separating rails of the tracks in operating direction, and trailed by second track-bound equipments for welding and grinding rails.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
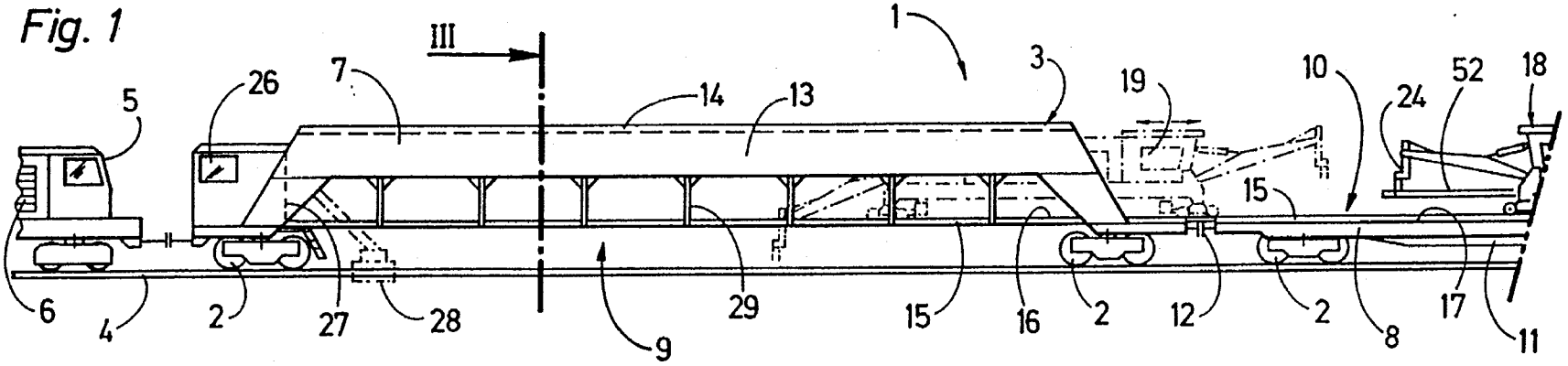
FIG. 1 is a side elevational view of a forward portion of one embodiment of a mobile track working machine according to the present invention.

Throughout all the Figures, the same or corresponding elements are generally indicated by the same reference numerals.

Figure 2:
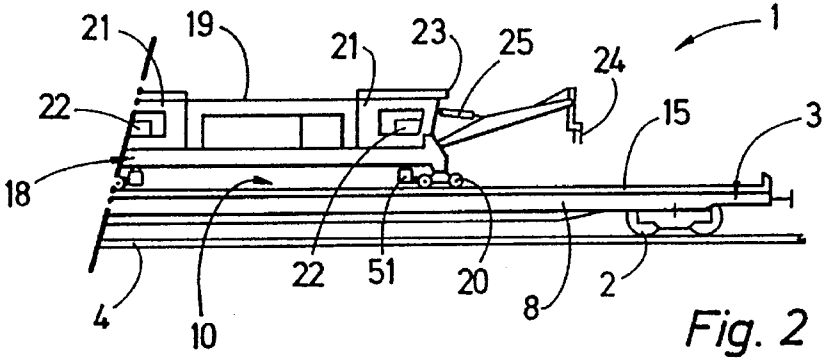
FIG. 2 is a side elevational view of a rearward portion of the track working machine of FIG. 1.

Turning now to the drawing, and in particular to FIGS. 1 and 2, there are shown side elevational views of a forward portion and rearward portion of one embodiment of a mobile track working machine according to the present invention, generally designated by reference numeral 1. The track working machine 1 exhibits an elongated machine frame 3 which is supported by undercarriages 2 for mobility along a track 4 in an operating direction when working a stretch of the track 4. The tractive force to pull the track working machine 1 in operating direction is effected by a locomotive 5 which is coupled to the forward end of the machine frame 3 and carries a central power plant 6 for supplying power to all operating drives and working units of the machine 1.

The machine frame 3 is typically of significant length and is thus suitably formed of two carrier frames 7, 8 which are arranged sequentially behind one another in operating direction and linked in by a suitable coupling, schematically indicated by reference numeral 12. The carrier frame 7 is positioned immediately behind the locomotive 5 and forms a first work section which is generally designated by reference numeral 9 and covers an area between two undercarriages 2. The other carrier frame 8 which immediately trails the carrier frame 7 in operating direction forms a second work section which is generally designated by reference numeral 10. In the nonlimiting example of FIGS. 1 and 2, the carrier frame 8 is formed by a flatbed car 11 which is supported by two undercarriages 2 and exhibits a loading deck 17.

The carrier frame 7 of the machine frame 3 that forms the first work section 9 includes essentially two elongated beams 13 which extend in parallel relationship to each other in the longitudinal direction and are spaced from one another across the machine frame 3. In the area of the first working section 9, the beams 13 are upwardly angled in a gooseneck fashion. As best seen in particular in FIG. 3, which is an enlarged sectional view of the track working machine 1 taken in direction of arrow III in FIG. 1, both beams 13 are connected together at their upper ends in the area between the undercarriages 2 by a traverse heading 14 so that the beams 13 and the traverse heading 14 form together a tunnel-like structure.

Positioned on the leading end of the carrier frame 7 is an operator's cab 26 which is formed with a passageway 27 between both beams 13 to enable personnel to access the job site and the track 4.

A pair of transversely spaced guide rails 15 is mounted onto the machine frame 3 and extends in longitudinal direction along the first and second work sections 9, 10. The guide rails 15 are laid in a plane 16 that is formed immediately above the undercarriages 2 and coincides with the loading deck 17 of the flatbed car 11, whereby the guide rails 15 are placed upon the loading deck 17 in the area of the second work section 10. In the area of the first work section 9, which is formed by the angled carrier frame 7, the guide rails 15 are propped by vertical supports 29 which are evenly spaced from one another in the longitudinal direction and secured to the elongated beams 13. The horizontal distance of the guide rails 15 across the machine frame 3 corresponds approximately to the relative distance between both beams 13, as shown in particular in FIG. 3.

Supported on the guide rails 15 is a self-propelled transport unit 18 which is equipped with a drive 51 for mobility of the transport unit 18 between the second work section 10 and the tunnel-like configuration of the first work section 9. The transport unit 18 is formed as gantry crane 19 which is supported by undercarriages 20 along the guide rails 15. At both its axial ends 23, the gantry crane 19 is provided with an operator's cab 21 which is equipped with a central control mechanism 22. The transport unit 18 is further provided with two grapplers 24, i.e. one grappler 24 on each longitudinal end 23 of the gantry crane 19. The grapplers 24 project beyond the axial ends of the gantry crane 19 and are vertically and laterally adjustable by the control mechanisms 22 via drives 25 for gripping and transporting track sections 52.

It will be understood by persons skilled in the art that in contrast to the configuration shown in the drawing, it is certainly within the scope of the present invention to also mount the guide rails 15 to the underside of the traverse heading 14 to thereby form an overhead construction from which the transport unit 18 is suspended.

Figure 3:
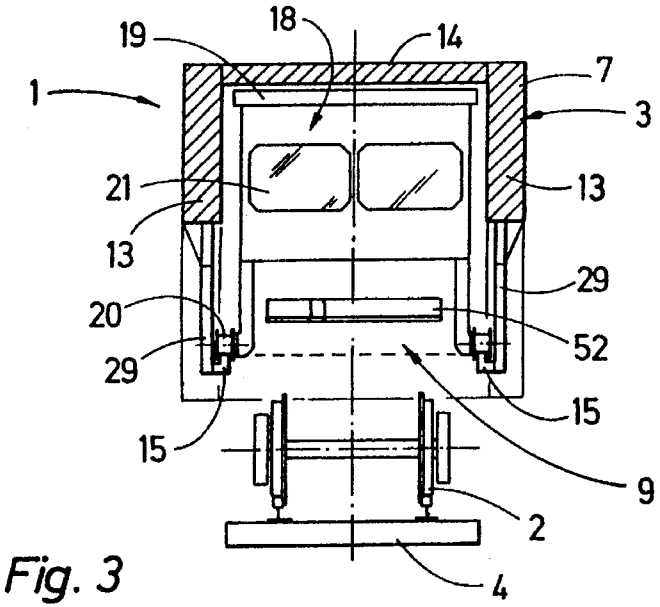
FIG. 3 is an enlarged sectional view of the track working machine, taken in direction of arrow III in FIG. 1.

As shown in FIG. 3, a track section 52 of e.g. a switch can be positioned between the underside of the operator's cab 21 and the plane of the guide rails 15. For ease of illustration, the grapplers 24 which carry the guide rails 15 are not shown in detail in FIG. 3.

When carrying out rail maintenance work, the track working machine 1 is pulled by the locomotive 5 to the construction site and positioned such that the first work section 9 of the machine frame 3 is located above the stretch of the track 4 on which work is to be performed. The gantry crane 19 which is able to travel substantially over the entire length of the track working machine 1 transports old track elements 52 and new track elements 52 for installation at the job site between the first work section 9 and the flatbed car 11 of the second work section 10 on which the track elements 52 are stored. The tunnel-like configuration of the carrier frame 9 that forms the first work section 9 above the guide rails 15 enables the gantry crane 19 to travel in an unobstructed manner over the entire work area while at the same time the grapplers 24 can be pivoted unimpededly downwards and shifted sideways at track level for carrying out a wide range of operations. FIG. 1 also shows by way of dash-dot line the gantry crane 19 in a position in which the gantry crane 19 has partially traveled into the tunnel formed by the carrier frame 7.

Through passageway 27 of the operators cab 26, the maintenance personnel is able to haul further hand-operated equipment to the job site. Also conceivable is the introduction in this area of other equipments, such as for example a vertically and laterally adjustable rail welding unit, as designated by reference numeral 28 and shown in dash-dot line, for simultaneous use with the transport unit 18. It is especially noteworthy that there is no necessity to exceed the clearance gage during the entire manipulation for removing old track elements and installing new track sections.

Figure 4:
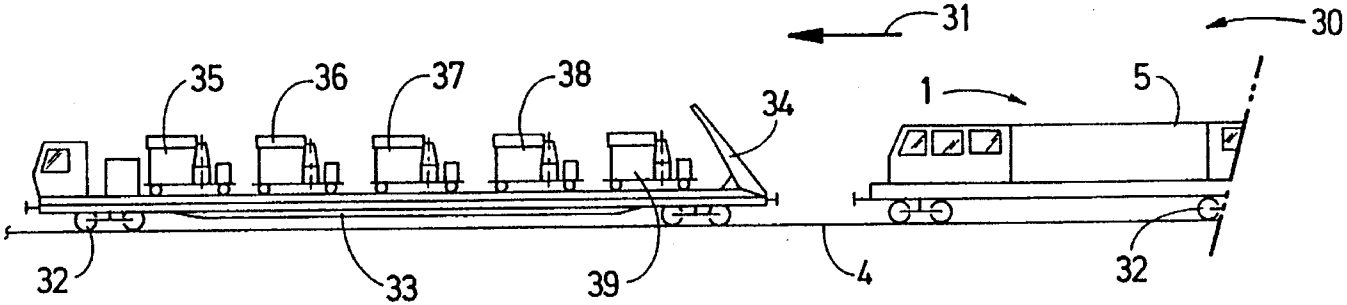
FIG. 4 is a schematic side elevational view of a forward section of an exemplified arrangement of a mobile work train for performing track work, incorporating a track working machine according to the present invention.
Figure 5:
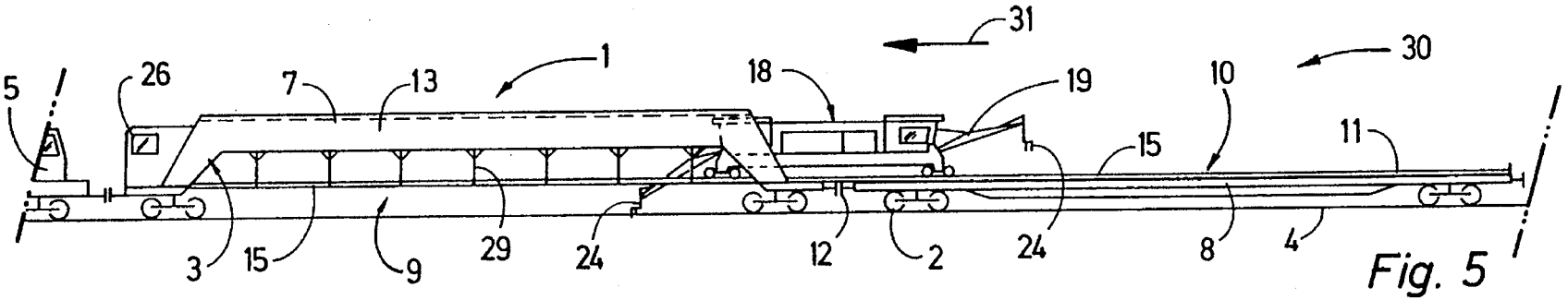
FIG. 5 is a schematic side elevational view of a central section of the work train of FIG. 4.
Figure 6:
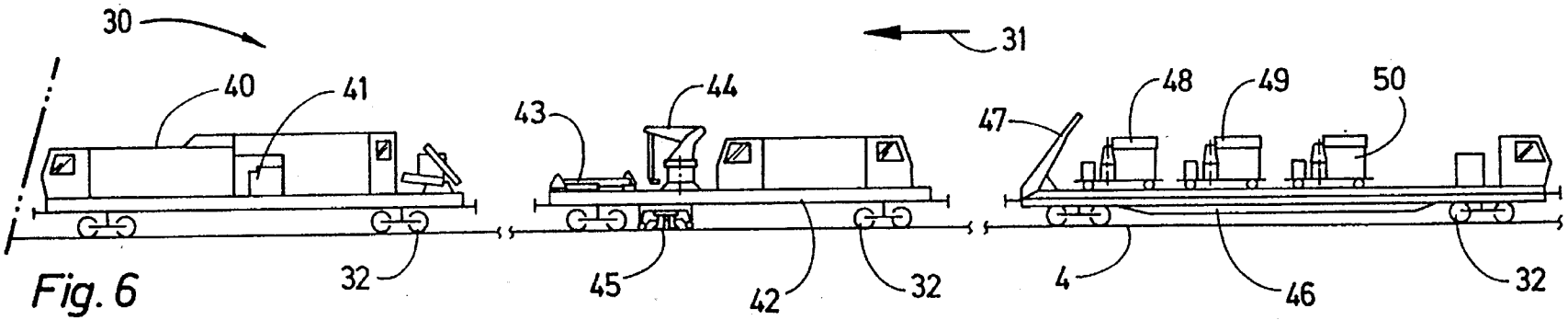
FIG. 6 is a schematic side elevational view of a rearward section of the work train of FIG. 4.

Turning now to FIGS. 4 to 6, there are shown schematic side elevational views of an exemplified arrangement of a mobile work train for performing track work, generally designated by reference numeral 30 and traveling on track 4 in direction of arrow 31, with FIG. 4 showing a forward portion of the work train 30, FIG. 5 showing a central portion thereof and FIG. 6 showing a rearward portion thereof. The work train 30 is particularly formed for rapid renewal of track sections and includes in combination with a track working machine 1 and its locomotive 5, as shown in FIGS. 1 to 3, a lineup of several cars 33, 40, 42, 46 which are arranged behind each other in operating direction and self-propelled by respective separate drives 32.

FIG. 4 shows that the work train 30 is led by the loading car 33 which exhibits on its trailing end a loading ramp 34 that can be swung upwardly, for placing onto the track 4 individual equipments 35, 36, 37, 38, which travel on the loading car 33 via flanged rollers on respective rails. In particular, the loading car 33 includes in succession a spike puller 35, a tie anchor remover 36, a clip remover 37, a rail end grinder 38 as well as a rail web grinder 39. As shown in FIG. 5, the loading car 33 is followed by the track working machine 1, including the flatbed car 11 and the transport unit 18 which runs on the guide rails 15.

Trailing the track working machine 1 is a separate self-propelled welding machine 40 with vertically adjustable welding unit 41, which is followed by a car 42 supporting a rail pulling unit 43, a jib 44 for positioning the rail pulling unit 43, as well as a rail head grinder 45. This configuration is shown in FIG. 6. The rear end of the work train 30 is formed by a further loading car 46 with loading ramp 47 for supporting various individual equipments running on flanged rollers, such as a spike machine 48, tie anchor depositing unit 49 and a clip depositing unit 50.

The example of the work train 30, as shown in FIGS. 4 to 6, enables to carry out all operations necessary to exchange track elements.

While the invention has been illustrated and described as embodied in a track working machine, it is not intended to be limited to the details shown since various modifications and structural changes may be made without departing in any way from the spirit of the present invention.

What is claimed as new and desired to be protected by Letters Patent is set forth in the appended claims:

1. A track working machine; comprising:

a machine frame extending in longitudinal direction along a track and supported by undercarriages for mobility in an operating direction along the track, said machine frame exhibiting a first work section situated between two undercarriages and a second work section immediately trailing the first work section in the longitudinal direction; and a self-propelled transport unit traveling along guide rails that are mounted to the machine frame and extend in the longitudinal direction;

said machine frame being formed in the area of the first work section essentially by two parallel beams extending in the longitudinal direction and spaced transversely to the machine, and by a traverse heading positioned above the guide rails for connecting the parallel beams to one another, thereby providing the machine frame with a tunnel-like configuration for allowing said transport unit to move from the second work section underneath the traverse heading into the first work section while providing the machine frame with a sufficient stiffness.

2. The machine of claim 1 wherein the beams in the first work section are upwardly angled with the traverse heading being positioned in an upper end area of the beams.

3. The machine of claim 1 wherein the guide rails extend in the first and second work sections in a plane immediately above the undercarriages.

4. The machine of claim 1 wherein the transport unit is formed by a gantry crane supported by undercarriages on the guide rails and including a grappler means for gripping and transporting track sections, said gantry crane being equipped with an operator's cab.

5. The machine of claim 4 wherein the transport unit has opposing ends, each of which exhibiting one operator's cab equipped with a central control mechanism, said grappler means including two grapplers, respectively projecting from the opposing ends, and drive means for vertically and laterally adjusting the grapplers.

6. The machine of claim 1 wherein the machine frame has one distal end in relation to the second work section, and further comprising an operator's cab positioned on the distal end and exhibiting a passageway positioned between the beams.

7. The machine of claim 1 wherein the machine frame includes two carrier frames arranged sequentially behind one another in the longitudinal direction and hingedly connected together for respectively forming the first and second work sections.

8. The machine of claim 7 wherein one carrier frame that forms the second work section is configured as flatbed car supported by two undercarriages, and further comprising a coupling for detachably linking said one carrier frame with the other one of the carrier frames that forms the first work section.

9. A work train for performing track work, comprising:

a) a track working machine having a machine frame extending in longitudinal direction along a track and supported by undercarriages for mobility in an operating direction along the track, said machine frame exhibiting a first work section situated between two undercarriages and a second work section immediately trailing the first work section in the longitudinal direction;

a self-propelled transport unit traveling along guide rails mounted on the machine frame in the longitudinal direction, wherein the machine frame is formed in the area of the first work section essentially by two parallel beams extending in the longitudinal direction and spaced transversely to the machine, and by a traverse heading positioned above the guide rails for connecting the parallel beams to one another, thereby providing the machine frame with a tunnel-like configuration for allowing said transport unit to move from the second work section underneath the traverse heading into the first work section while providing the machine frame with a sufficient stiffness;

b) first track-bound mobile equipments preceding the track working machine in operating direction for removing rail fasteners and separating rails of the track; and c) second track-bound mobile equipments trailing the track work machine for rail welding and rail grinding operations.

* * * * *